United States Patent [19]

Thornton et al.

[11] 4,408,177

[45] Oct. 4, 1983

[54] VARIABLE INDUCTOR HAVING EXTENDED USEABLE FREQUENCY RANGE

[75] Inventors: Jack C. Thornton, Satellite Beach, Fla.; Randy G. Russell, Arlington Heights, Ill.

[73] Assignee: Rockwell International Corporation, El Segundo, Calif.

[21] Appl. No.: 364,293

[22] Filed: Apr. 1, 1982

[51] Int. Cl.[3] ..... H01H 51/08

[52] U.S. Cl. ..... 336/139; 336/137; 336/140; 336/141; 336/144; 336/149

[58] Field of Search ..... 336/137, 139, 140, 141, 336/144, 149

[56] References Cited

U.S. PATENT DOCUMENTS 2,331,522 10/1943 Vance ..... 336/140 X
2,415,736 2/1947 Flood et al. ..... 336/140 X
3,156,888 11/1964 Blanco ..... 336/139 X
4,064,474 12/1977 Adams et al. ..... 336/139

*Primary Examiner*—A. T. Grimley
*Attorney, Agent, or Firm*—Terry M. Blackwood; Howard R. Greenberg; H. Fredrick Hamann

[57] ABSTRACT

A plurality of moveable contactors may travel along a rotating coil, one end of which is conductive and the other end of which is non-conductive. Two or more electrically interconnected moveable contactors effect a shorting across unused electrical turns and thereby affect unused coil portion resonance. For tuning conditions where very little of the coil is unused, the non-conductive coil portion serves as a sidetrack onto which one or more contactors can move and acts as a mechanical storage or memory for preserving relative positions between contactors.

6 Claims, 2 Drawing Figures

VARIABLE INDUCTOR HAVING EXTENDED USEABLE FREQUENCY RANGE

The present invention is generally related to variable inductance apparatus and more specifically to radio frequency or other high voltage tuneable electrical coils.

One common variable inductance electrical coil is the conventional and well-known roller or rotary coil. The roller coil comprises an electrical coil or solenoid plus a conductive roller or trolley wheel contactor supported on an electrically conductive guide or bar which extends the entire length of the coil. These and other existing high inductance coils are often restricted in the frequency range over which they are useable. Such restriction is due to the unused portion of the coil or solenoid going resonant at certain frequencies and causing a power loss in the active circuit. The high currents generated in the resonant unused portion of the coil dissipate power and such dissipated power represents power that is not going to the load. Therefore, the load power drops off as the unused coil portion goes resonant. In addition, high voltages and currents are generated in the unused coil portion and these can damage the coil assembly due to voltage breakdown or excessive current heating. One prior art solution is to stop using the coil at some frequency and break up the unused portion resonances by putting multiple shorts onto and across appropriate sections of the unused coil portion. Quick connection shorting means (employing, for example, alligator clips) are typical of one approach. A somewhat more mechanized prior art approach has been to connect a plurality of wires to turns of the coil at various coil positions and to run all of these wires to one or more shorting switches.

Yet another prior art approach is shown in U.S. Pat. No. 3,958,196 assigned to the assignee of the present invention. Said patent shows a variable inductor having a non-rotating coil along with a sliding flexible conductive ribbon for shorting out selected turns of the coil. The tuning and shorting are stepped rather than continuous, the smallest tuning increment being one whole turn.

In accordance with the present invention, these problems are addressed and resolved by apparatus which provides multiple moveable contactors each capable of continuously contacting the electrical coil, and which further provides a mechanical storage or memory system for preserving the relative position of the contactors when they are not needed for a particular tuning condition.

Figure 1:
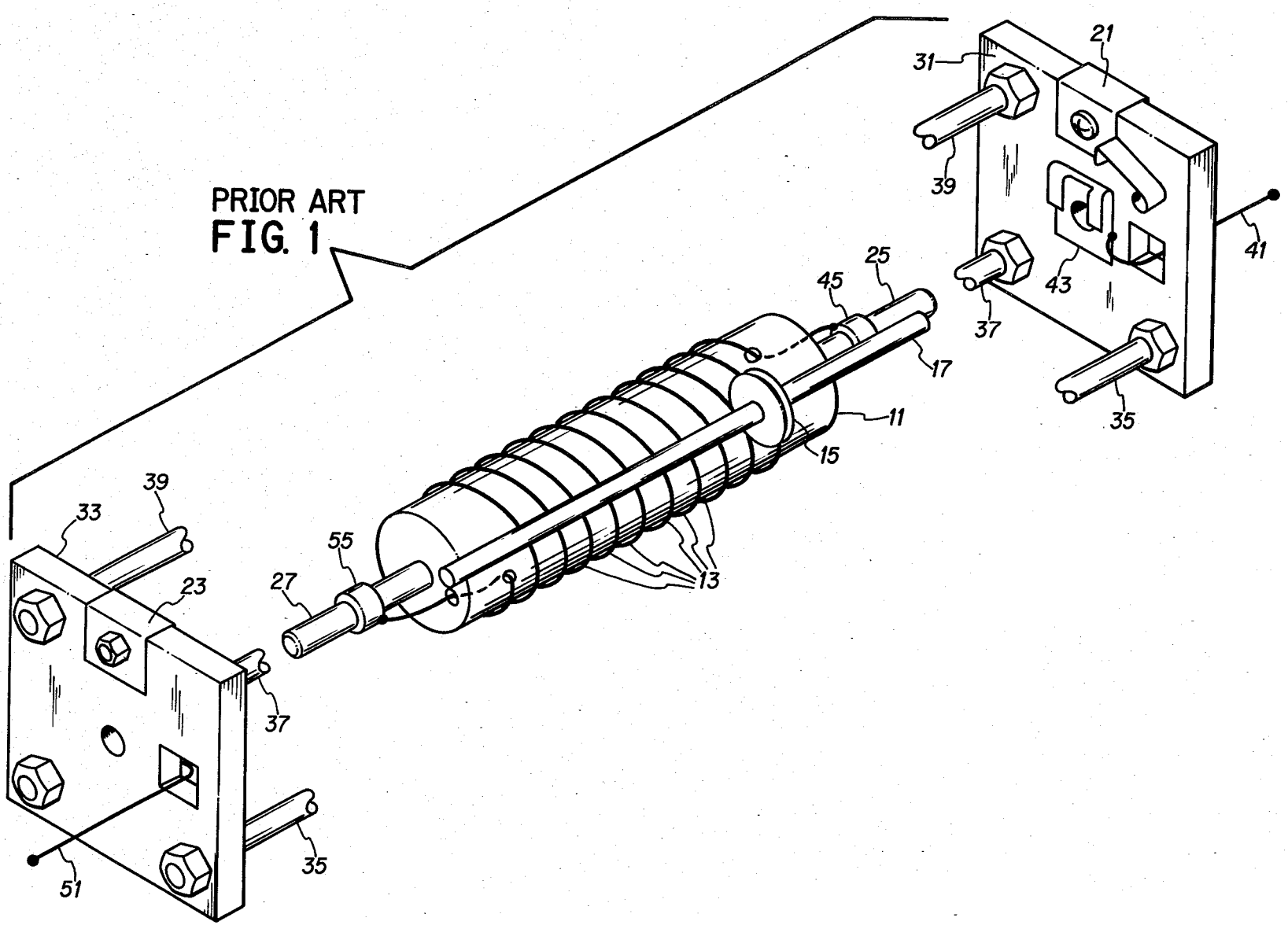
PRIOR ART FIG. 1
Figure 2:
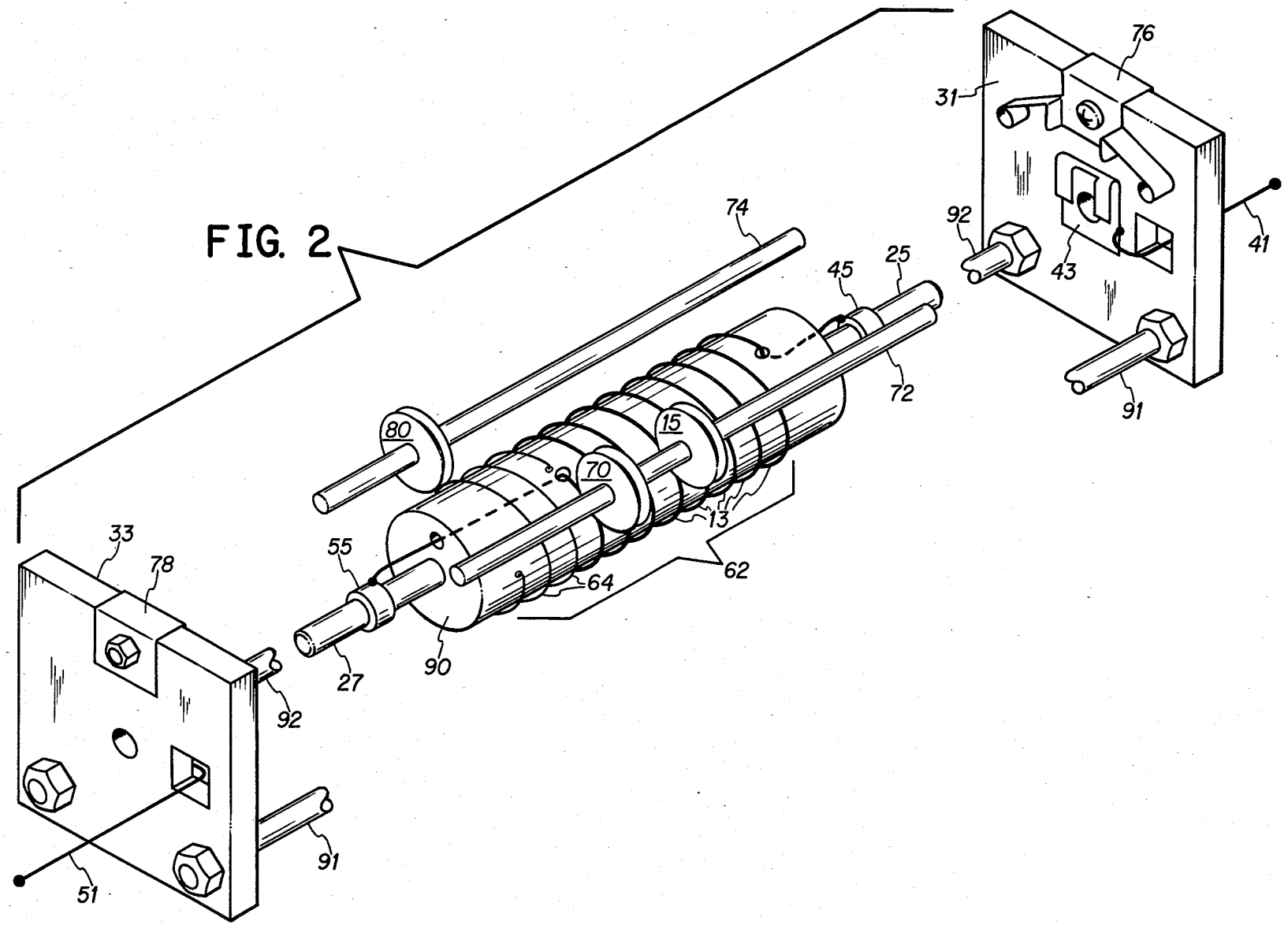

These and other features, objects, and advantages of the invention will become more apparent upon reference to the following specification, claims, and appended drawings in which:

FIG. 1 is an exploded perspective view representing a prior art roller coil; and FIG. 2 is an exploded perspective view representing variable inductor apparatus incorporating the principles of the present invention.

Turning now to FIG. 1, the conventional and familiar roller coil represented therein comprises a non-conductive cylindrical form 11 bearing a coil 13 of substantially helically wound bare conductive wire, and further comprises a trolley wheel contactor 15 carried by conductive guide 17. Trolley wheel contactor 15 is grooved or curved around its circumference so as to mate with or receive the coil wire. Guide 17 is held substantially parallel to the side of the coil by conductive spring-suspension mounts 21 and 23 which also serve as electrical terminals. Axially located shafts 25 and 27 protruding from the two form ends are journaled through openings in non-conductive end plates 31 and 33. Rods 35, 37 and 39 secure end plates 31 and 33 together and the secured plates hold the form and coil and allow rotation of the coil about is central axis.

Electrical connection or access to the far end of the coil is via electrical wire or terminal 41, brush 43, and slip ring 45. Electrical connection or access to the near end of the coil is via electrical terminal 51, brush 53 (not shown), and slip ring 55. Electrical connection or access to the roller/trolley wheel 15 and the point of the coil it touches is via either of mount-terminals 21 or 23, and via guide bar 17.

Trolley wheel 15 is free to turn about guide 17 and is also free to slide therealong. As the coil is rotated about its axis, the coil acts like a worm or screw and drives the wheel 15 along the guide 17. Thus, a variable inductance is available between either end of the coil and the trolley wheel contactor.

The resonance problem briefly mentioned hereinabove can arise in the following manner. Assume that terminal 41 (and thus the far end of the coil) is connected to RF and that the roller/trolley wheel 15 is the other side of the used portion of the coil. Further assume that the frequency of the RF is near the high end of an employed frequency range and that only a small part of the electrical coil is used. The illustrated tuning condition is representative of such assumption. Since most of the coil is unused (for the illustrated tuning condition) and since, in general, resonant frequency decreases as inductance value increases, the resonant frequency of the unused portion may well be too low to be compatible with the frequency for which the used portion is being used. If the user does not desire to replace the coil with a shorter one (i.e., one which would have less unused portion) then such user typically would effect a shorting between certain turns of the unused portion to increase the resonant frequencies of the unused portion. Such shorting as mentioned hereinabove can be accomplished in several ways including using temporary quick connection shorting means.

Turning now to FIG. 2, there is represented apparatus for facilitating the effecting of shorts between turns of the unused coil portions. The variable inductance apparatus, represented in FIG. 2, although in accordance with the principles of the invention, is similar in many respects to the FIG. 1 apparatus and thus in the interest of conciseness, redundant explanation and description will be minimized or avoided where practical. Like designators are employed for like elements in the two figures.

To briefly preface the improvements of the FIG. 2 represented apparatus, multiple roller or trolley wheel contactors are employed, and the coil 62 comprises an electrically conductive first portion 13 which is substantially a conventional electrical coil, plus a second portion 64 which is an electrically non-conductive extension of the first portion. More particularly, in addition to the roller wheel 15 which tunes the inductance value and establishes one end of the used coil portion, one or more additional roller wheel contactors such as 70 and/or 80 are employed on the unused coil portion side of the tuning contactor 15. Furthermore, a non-conductive filament (similar in dimensions to the electrical conductor used for the electrical coil portion) is wound around the near end of the form 90 so as to constitute second coil portion 64 and so as to substantially continue the helical pattern established by the electrically conductive first portion.

More detailedly now, trolley wheel contactors 15 and 70 are carried by conductive guide 72 and are free to turn about and travel along guide 72. A second conductive guide 74, like guide 72, is held substantially parallel to the side of the coil by conductive spring-suspension mounts 76 and 78. Mounts 76 and 78 also serve as electrical terminals and are analogous to mounts 21 and 23 of the FIG. 1 apparatus but are somewhat modified versions made suitable for holding two guides instead of one. A third trolley wheel contactor 80 is carried by the second guide 74 and is free to turn about and travel along guide 74. Contactors 15, 70, and 80 are all shorted together because guides 72 and 74, and mount-terminals 76 and 78 are conductive.

The coil 62 wound upon form 90 comprises a conductive electrical coil portion 13 and a non-conductive portion 64. Portion 13 is basically the same as coil 13 of the FIG. 1 apparatus and serves both as an electrical coil and as a mechanical worm. Non-conductive portion 64 serves as a mechanical worm extension of the portion 13 and follows a helical path substantially like the path of coil portion 13. The near electrical end of coil 13 passes through an opening to the inside of form 90 and the wire is extended therein so as to exit the form and connect to slip ring 55. The far end or beginning of non-conductive coil portion 64 is located adjacent the near end of the conductive coil portion 13, i.e., is located near the form opening where the conductor passes to the inside of the form. The adjacent ends of the two coil portions are sufficiently adjacent that the trolley wheels move smoothly from one "track" to the other. In this sense, the trolley wheels maintain their continuous contact with the coil 62 even as they make the transition between coil portion 64 and coil portion 13.

For the FIG. 2 apparatus to have the same inductance range as the FIG. 1 apparatus, the coil form 90 is elongated so as to accommodate the added non-conductive coil portion 64. Guides 72 and 74, and securing rods 91 and 92 are all elongated relative to their FIG. 1 counterparts to accommodate the elongated form 90 and the coil 62 thereon.

As the coil 62 is rotated, it acts like a worm or screw to simultaneously drive trolley wheel contactors 15, 70, and 80 along their respective guides substantially parallel to the side of the coil 62. As trolley wheels 15, 70, and 80 travel along their paths, each continuously contacts the coil 62 and contacts only one turn at a time. As indicated in FIG. 2, each of the trolley wheels is narrow enough such that it will not simultaneously contact two adjacent coil turns.

The position of each wheel contactor relative to the other two is maintained throughout the tuning range because all wheels are always in contact with some part, either conductive or non-conductive, of the worm. The three contactors are spaced relative to one another to ensure that the unused inductor resonant frequencies are always higher than the frequency of operation. As the electrical coil portion 13 is tuned so that most of the coil 13 is used, the shorting contactors are stored on the non-conductive continuation 64 of the electrical coil 13. The contactors move normally onto the nonconductive portion. In doing this they retain their relative mechanical position to the active contactors when returned to the coil active circuit. Thus the non-conductive portion 64 acts as a "sidetrack" and serves to provide contactor position memory and storage. In a tuning condition where most of the coil portion 13 is unused, all three wheels simultaneously contact conductive portion 13, and thus a short is impressed across the turns between wheels 15 and 70, and a short is also impressed across the turns between wheels 70 and 80. In an intermediate tuning condition where approximately half of the coil portion 13 is unused, the wheel contactor 80 may have traveled off the conductive worm portion onto the non-conductive portion while the wheel contactors 15 and 70 remain in contact with the conductive portion, whereby a short is impressed across the conductive turns between wheel contactors 15 and 70. In a tuning condition where very little of the coil portion 13 is unused, both wheel contactors 70 and 80 may have traveled off the conductive worm portion onto the non-conductive portion leaving only the wheel contactor 15 in contact with the conductive portion, whereby no shorting of unused conductive turns is effected.

Typical of the threadlike filament material useable for providing the non-conductive coil portion 64 is a nylon mono filament line material. Such material is non-conductive and has dimensions similar to conductive coil wire and may be wound on the form much like wire.

In some embodiments it may be desirable to have, in addition to the tuning contactor wheel 15, only one shorting contactor wheel 70 or 80. In such instances, either of contactor wheels 70 or 80 may be omitted. It of course may be desirable to employ more than the two shorting contactor wheels illustrated in FIG. 2. It should be noted however that it is preferred that the number of wheels per guide be limited to two in order to ensure that all of the wheel contactors remain in contact with the coil 62 at all times. It of course will be appreciated that the non-conductive coil portion 64 could comprise something other than the non-conductive filament wound upon the form 90. For instance, coil portion 64 could comprise ribs molded into the form 90 according to a substantially helical path and formed in dimensions suitable for accommodating the trolley wheels and presenting the wheels a track continuation or "sidetrack".

The basic principles may also be applied to other types of helical coils including pancake coils, and also to helical coils which follow a helical path whose pitch is variable instead of constant and/or helical coils wound around a truncated cone form instead of a cylindrical form. In such cases, the contactor wheels would still follow paths substantially parallel to the side of the coil.

Thus, while various embodiments of the present invention have been shown and/or described, it is apparent that changes and modifications may be made therein without departing from the invention in its broader aspects. The aim of the appended claims, therefore, is to cover all such changes and modifications as fall within the true spirit and scope of the invention.

What is claimed is:

1. A variable inductor comprising:

rotatable, substantially helical coil means comprising first and second coil portions situated substantially end to end, said first coil portion comprising multiple turns of electrical conductor, said second coil portion comprising an electrically non-conductive extension of said first coil portion such that said first and second coil portions together serve substantially as a mechanical worm;

a plurality of moveable contactors located exteriorly of said coil means and each comprising conductive means for, as the coil means is rotated, (i) continuously contacting said coil means one turn at a time and (ii) traveling substantially parallel to the side of the coil means;

said contactors being situated relative to one another such that in a first tuning condition, two of the plurality of contactors may simultaneously contact the first coil portion, and such that in a second tuning condition one of the same two contactors may contact the first coil portion while the other contacts the second coil portion.

2. A variable inductor as defined in claim 1 wherein said plurality of moveable contactors comprises a plurality of wheels each of which is grooved around its circumference so as to be suitable for receiving and riding along said coil means.

3. A variable inductor as defined in claim 1 and further including a coil form, and wherein said second coil portion comprises a non-conductive filament wound upon said form.

4. A variable inductor as defined in claim 1 and further including a coil form, and wherein said second coil portion comprises ribs on said form.

5. A variable inductor as defined in claims 1 or 2 and further including means for electrically shorting together at least two of the plurality of moveable contactors.

6. A variable inductor as defined in claims 1 or 2 and further including means for electrically shorting together all of the moveable contactors.

* * * * *